United States Patent [19]

Oguri et al.

[11] Patent Number: 4,572,751

[45] Date of Patent: Feb. 25, 1986

[54] CAST IRON MOLD FOR PLASTIC MOLDING

[75] Inventors: Itsuro Oguri, Nagoya; Yasuhiro Miyamoto, Handa, both of Japan

[73] Assignee: NGK Insulators, Ltd., Japan

[21] Appl. No.: 617,930

[22] Filed: Jun. 6, 1984

[30] Foreign Application Priority Data

Jun. 15, 1983 [JP] Japan ..... 58-107521

[51] Int. Cl.[4] ..... C21D 5/00; C22C 37/04

[52] U.S. Cl. ..... 148/35; 75/123 CB; 148/139; 249/135; 164/58.1

[58] Field of Search ..... 249/135; 164/57.1, 58.1; 148/35, 139; 75/123 J, 123 L, 123 K, 123 CB

[56] References Cited

U.S. PATENT DOCUMENTS

| | | | |
|---|---|---|---|
| 3,702,269 | 11/1972 | Church | 148/35 |
| 4,153,477 | 5/1979 | Beyer et al. | 148/35 |
| 4,236,944 | 12/1980 | Yaman et al. | 75/123 CB |
| 4,435,226 | 3/1984 | Neuhauser et al. | 148/35 |
| 4,484,953 | 11/1984 | Kovacs et al. | 148/138 |

FOREIGN PATENT DOCUMENTS

| | | | |
|---|---|---|---|
| 2757114 | 7/1978 | Fed. Rep. of Germany | 148/139 |
| 47-4791 | 9/1972 | Japan | 148/35 |

OTHER PUBLICATIONS

Dubois et al., "Plastics Mold Engineering Handbook," Van Nostrand Reinhold Co., 1978, pp. 149–150.

*Primary Examiner*—S. Leon Bashore
*Assistant Examiner*—K. M. Hastings
*Attorney, Agent, or Firm*—Parkhurst & Oliff

[57] ABSTRACT

A cast mold for plastic molding, made of a nodular graphite cast iron comprising spheroidal graphite particles. The mold includes a peripheral portion defining a molding surface which contacts a plastic material to be molded. At least the peripheral portion of the mold has a particle size distribution of spheroidal graphite in which not less than 90% of the graphite particles are not greater than 10 microns, and not less than 50% of the graphite particles are not greater than 6 microns. Preferably, the nodular graphite cast iron consists by weight of 2.5–3.8% of carbon, 2.0–3.0% of silicon, not more than 0.8% of manganese, 2.0–5.0% of nickel, 0.2–1.0% of molybdenum, and the balance being iron, spheroidizer and impurities.

4 Claims, 2 Drawing Figures

CAST IRON MOLD FOR PLASTIC MOLDING

BACKGROUND OF THE INVENTION

The present invention relates to a mold for molding plastics, made of a nodular or spheroidal graphite cast iron.

In the art of molding or forming plastic materials, there have been used molds which are castings of various steel materials. Since a steel material generally undergoes a high degree of shrinkage when its melt is solidified, it is relatively difficult to cast steel molds with satisfactory dimensional accuracy. Further, the high shrinkage percentage of the steel material causes not a few cracks of such steel molds at their corner sections. Thus, such traditional cast steel molds for plastic molding are not completely satisfactory.

SUMMARY OF THE INVENTION

It is accordingly an object of the present invention to provide a cast mold usable for molding a plastic material, which has an improved dimensional accuracy, a minimum cracking at its corner portions, and an enhanced smoothness of its plastic-molding surface.

A cast mold according to the invention for molding a plastic material, is made by casting of a nodular graphite cast iron comprising spheroidal or nodular graphite particles. A molding surface of the mold which contacts the plastic material for molding it into a desired shape, is defined or formed by a peripheral portion of the mold which has a particle size distribution of spheroidal graphite in which at least 90% of the graphite particles are less than or equal to 10 microns and at least 50% of the graphite particles are less than or equal to 6 microns. That is, at least the peripheral portion has the above particle distribution of spheroidal graphite.

The use of a nodular graphite cast iron, rather than a steel material, for a plastic forming mold according to the invention, is intended to minimize or prevent the above indicated drawbacks of dimensional inaccuracy and corner cracking as experienced on a known mold made of a steel material. According to the invention, the size distribution of the spheroidal graphite particles contained in the peripheral portion of the mold is controlled to fall within the range specified above. This control of the graphite particle size distribution is contemplated to provide an improved smoothness of the molding surface which is defined by the peripheral portion, since the surface finish of the molding surface is of prime importance to the quality of a molded plastic product. In this connection, it is noted that the principle of the invention does not require the other portions of the mold to meet the graphite particle size distribution specified above.

The nodular graphite cast iron used according to the invention is obtained by using a spheroidizing agent or agents such as magnesium and ceriulm and an innoculant such as ferro-silicon, which spheroidizing agents and innoculant serve to spheroidize or nodularize crystallized graphite of a cast iron. The nodular graphite may be divided into fine particles by means of rapidly cooling a molten metal immediately after the molten metal is poured into a casting pattern or master pattern for casting a mold of the invention. Described in more detail, the mold of the invention may be readily produced by first pouring a melt into a casting pattern, made of steel or other material, with high thermal conductivity and good heat dissipation capacity, then applying a pressure of 30 kg/cm$^2$ or higher to a mass of the melt immediately after the pouring into the casting pattern to obtain a close contact of the melt with surfaces of the casting pattern, and rapidly cooling the melt while allowing the heat of the melt to be dissipated through the highly thermally conductive casting pattern, thereby solidifying the melt into a mold of the invention which has the specified graphite particle size distribution. The cooling of the melt must be effected at a rate of not lower than 20 °C./min. until the temperature of the melt has been lowered down to 700° C. It is appreciated that the casting pattern employ a highly thermally conductive material only at a portion thereof which contacts a peripheral portion of the mold of the invention defining a plastic-molding surface of the latter, so that such thermally conductive material permits the control of the size distribution of the spheroidal graphite particles contained in the peripheral portion of the mold of the invention.

With the casting method stated above, the particle size distribution of the spheroidal or nodular graphite of the cast mold is controlled such that at least 90% of the spheroidal graphite particles are less than or equal to 10 microns in diameter and at least 50% of the same particles are less than or equal to 6 microns in diameter. Thus, at least the peripheral portion of the mold which forms a plastic-molding surface is provided with the spheroidal graphite particles the size distribution of which is controlled to fall within the specified range.

It is noted here that the term "plastic-molding surface" or "molding surface" used in this application is interpreted to mean a surface of the mold of the invention which contacts a plastic material during molding thereof with the mold. Further, the term "mold" means both or either one of a cavity mold having a female or concave molding surface, and a core mold having a male or convex molding surface, which female and male molding surfaces cooperating to define a shape of a plastic product to be molded with the "mold".

The control of the graphite particle size distribution according to the invention provides a significant improvement in smoothness of the plastic-molding surface of the mold, which accordingly improves glossiness and appearance of a plastic product to be molded with the mold of the invention. In the event the particle size distribution of spheroidal graphite of a mold is not held within the range stated above, the plastic-molding surface will not have a satisfactory smoothness even after grinding thereof in any manner, because the ground mold surface tends to have voids or indentations due to absence of graphite particles.

As previously indicated, a nodular graphite cast iron is less likely to shrink upon solidification thereof from its molten state, than a steel material. This means an enhanced dimensional accuracy of a mold made of a nodular graphite cast iron. According to an advantageous form of the invention, the nodular graphite cast iron consists of: 2.5–3.8% by weight of carbon; 2.0–3.0% by weight of silicon; not more than 0.8% by weight of manganese; 2.0–5.0% by weight of nickel; 0.2–1.0% by weight of molybdenum; and a balance being iron, spheroidizing elements, and inevitable impurities which are necessarily present in the cast iron. The composition of the nodular graphite cast iron defined above provides a mold with improved smoothness of its molding surface, improved dimensional accuracy, and increased hardness and strength.

Described more specifically, carbon is an element which serves to lower a melting point and a shrinkage percentage of the cast iron. For minimizing a variation in volume of the moten iron upon solidification thereof, a carbon content is preferably held less than 3.8% because of development of a hyper-eutectoid structure in this range of carbon content. A carbon content in excess of this upper limit will cause an excessive generation of pro-eutectoid graphite. On the other hand, the carbon content of less than 2.5% will elevate the melting point of the cast iron and therefore requires an elevated temperature of the melt, thereby causing an increased variation in volume, i.e., an increased shrinkage when the melt is solidified. For the above reasons, a preferred range of the carbon content is from 2.5 to 3.8%. Silicon is an element which contributes to spheroidization of graphite. With the silicon content being less than 2.0%, the contribution of silicon to the graphite spheroidization is not sufficient, whereby the cast mold will have uneven hardness due to generation of chill (cementite) and suffer an increase in shrinkage percentage, which results in easy cracking. However, if the silicon content is in excess of 3.0%, the amount of pro-eutectoid graphite will be increased and the graphite particles tend to be greater. Thus, the silicon content is preferably held within a range of 2.0–3.0%. The content of the third element, manganese, is preferably less than 0.8%, otherwise the mold is more likely to undergo chilling at the rapidly cooled portions. Nickel serves as an element for maintaining even or uniform high hardness of the cast mold. This hardening effect is not satisfactory when the nickel content is less than 2.0%. However, more than 5.0% of nickel will lead to local development of martensite in the cast iron and consequently to uneven hardness thereof. Hence, a preferred range of the nickel content is found to be from 2.0 to 5.0%. Molybdenum cooperates with nickel to contribute to formation of bainite. This contribution of molybdenum is insufficient if its content is less than 0.2%, while the presence of molybdenum in excess of 1.0% results in local development of martensite. Thus, it is preferred that the molybdenum content be held in a range of 0.2–1.0%.

The above and other objects, features and advantages of the present invention will be better understood from reading the following description of the preferred embodiments taken in connection with the accompanying drawing.

DETAILED DESCRIPTION OF THE PREFERRED EMBODIMENTS

The invention will be more clearly understood with reference to the following examples. However, these examples are intended to merely illustrate the invention and are not to be construed to limit the scope of the invention.

EXAMPLE 1

A master pattern made of suitable hot work dice steel was filled with a molten metal which consists of 3.6% by weight of carbon, 2.7% by weight of silicon, 0.06% by weight of manganese, 3.5% by weight of nickel, 0.5% by weight of molybdenum, 0.025% by weight of magnesium, and a balance being iron, and inevitable impurities. Then, a pressure of 40 kg/cm$^2$ was applied to the molten metal in the master pattern, and a mold for plastic molding was cast with a cavity having a 105 mm diameter and a 15 mm depth. A peripheral portion of the cast mold forming a molding surface which contacts a plastic material, has a metallurgical microstructure shown in a microphotograph of FIG. 1 in 200-times magnification. An inspection of spheroidal graphite particles contained in the microstructure revealed that all graphite particles were less than or equal to 7 microns in diameter and that at least 90% of the graphite particles were less than or equal to 6 microns in diameter.

Figure 2:
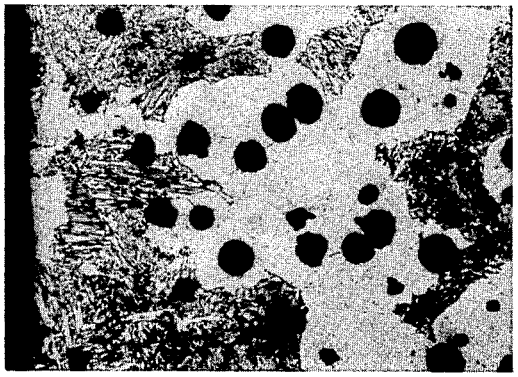
FIG. 2 is a photomicrograph at 200X showing a metallurgical microstructure of a plastic-molding surface of a mold which is cast of a melt with the same composition as that used for the mold of Example 1, but wherein the graphite particle size distribution is not controlled.

This result is in contrast with that of a microstructure, shown in FIG. 2, of a peripheral portion of a comparative plastic-forming mold which was cast of a molten metal having the same composition as that used for the mold of this example (Example 1), but without controlling a particle size distribution of the spheroidal graphite.

As clearly seen in FIG. 2, it was found the peripheral portion of the comparative mold had relatively large-sized spheroidal graphite particles in a dispersed state, and failed to provide a smooth plastic-molding surface.

Figure 1:
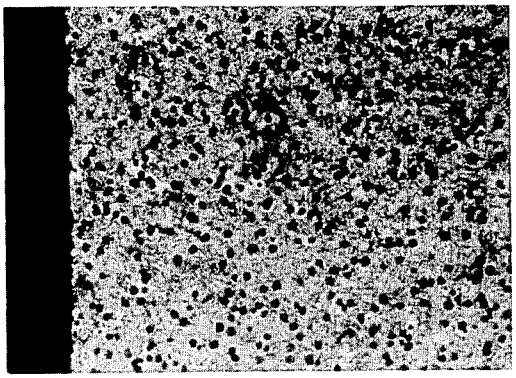
FIG. 1 is a photomicrograph at 200X showing a metallurgical microstructure of a plastic-molding surface of one preferred form of a cast mold of the invention, illustrated as Example 1, for molding a plastic material, wherein a particle size distribution of spheroidal graphite of the mold is controlled during casting thereof according to the invention.

The molding surface of the mold of Example 1 was subjected to hardness tests at three different locations A, B and C, in accordance with ISO R468. At each location, three measurements of hardness were obtained. The results are listed in Table 1, which shows that all measurements are held within Rockwell hardness $H_RC$ 35±2. Further, a total of five plastic-forming molds were cast according to the invention in the same manner, using a molten metal of the same composition and the same casting patterns as used for the mold whose microstructure is shown in FIG. 1. Diameters of cavities of the five molds obtained were measured. The measurements are listed in Table 2, which shows a very small variation, i.e., ±0.02 mm,. Thus, the measurements indicate an extremely high level of dimensional accuracy of the molds.

TABLE 1

| Locations | Hardness ($H_RC$) |
|---|---|
| A | 37; 35; 37 |
| B | 34; 35; 35 |
| C | 36; 34; 33 |

TABLE 2

| Mold Nos. | Cavity Diameter (mm) |
|---|---|
| 1 | 105.02 |
| 2 | 105.00 |
| 3 | 104.99 |
| 4 | 104.99 |
| 5 | 104.98 |

Further, the mold having the microstructure of FIG. 1 was tested for mechanical properties. The tests revealed a tensile strength of 110 kg/cm$^2$, a 0.2% yield stress (proof stress) of 60 kg/mm$^2$, an elongation of 12% and an impact value (Charpy impact) of 2 kg-m/cm$^2$. These results of the mechanical characteristics are comparable to those of high alloy steels.

EXAMPLE 2

A plastic-forming mold identical in shape to the molds of Example 1 was cast in the same manner using a moten metal which consists of 3.7% by weight of carbon, 2.6% by weight of silicon, 0.4% by weight of manganese, 0.03% by weight of magnesium, and a balance being iron and inevitably present impurities. An inspection of spheroidal graphite particles contained in a peripheral portion of the mold defining its plastic-molding surface, revealed that all graphite particles were 8 microns or less in diameter, and that at least 70% of the graphite particles were less than or equal to 6 microns. The plastic-molding surface of the mold as cast demonstrated a surface roughness (smoothness) of 3 $\mu$m in Rmax. The mold was ground at its plastic-forming surface, and filled with a plastic material to produce a plastic molding. The plastic product exhibited a surface roughness of 0.25 $\mu$m in Rmax, which is substantially equal to a surface finish quality of a product as obtained with a plastic-forming mold made of SKD-61 steel. Further, the mold of this example was tested in its dimensional accuracy. The test showed a dimensional variation of $\pm$0.04 mm per 100 mm, which is a drastic improvement over an accuracy of $\pm$0.3 mm per 100 mm of a traditional steel mold.

As described hitherto, a mold of the present invention for molding a plastic material is made by casting of a nodular or spheroidal graphite cast iron, and the distribution of particle size of the spheroidal graphite is controlled at least in a peripheral portion of the mold such that at least 90% of the graphite particles are less than or equal to 10 microns and at least 50% of the particles are less than or equal to 6 microns. The use of the nodular graphite cast iron, and the control of the graphite particle size distribution, permit the cast mold to have a considerably improved smoothness of its plastic-molding surface. This improvement of the surface smoothness or finish is obtained also when the invention is embodied as a core mold as well as a cavity mold. Thus, the present invention provides improved cast mold for plastic molding, more particularly, improves a smoothness of the plastic-molding surface of the mold which contacts with a mass of plastics to mold it into a desired shape. As a result, the plastic molding produced by the mold of the invention is improved in its surface quality and appearance. In addition, the low shrinkage property of a nodular graphite cast iron upon solidification thereof during casting, contributes to protection of the mold against cracking due to shrinkage, and allows a high dimensional accuracy of the mold which may meet a standard of ISO 2768 Fine Series. The surface quality and dimensional accuracy of the mold made by casting according to the invention are considered to be comparable to those of a mold which is manufactured by machining a high alloy steel. Since the mold of the invention has a satisfactory level of as-cast dimensional accuracy, the conventional need of grinding the plastic-molding surface may be substantially eliminated, whereby the delivery (required period of manufacture) and the cost of manufacture of a mold may be reduced to about two-thirds and four-fifths, respectively, of those required on the traditional molds. These time and cost savings will contribute to further progress of the industries involved.

What is claimed is:

1. A nodular graphite cast iron mold for molding plastics comprising:

a composition which consists of 2.5–3.8% by weight of carbon, 2.0–3.0% by weight of silicon, not more than 0.8% by weight of manganese, 2.0–5.0% by weight of nickel, 0.2–1.0% by weight of molybdenum, and the balance being iron, spheroidizing elements and impurities which are necessarily present in the nodular graphite cast iron; and said carbon is crystallized from a melt to result in crystallized spheroidal graphite particles in a peripheral portion of said mold having a particle size distribution wherein at least 90% of the crystalized spheroidal graphite particles are less than or equal to 10 microns in size and at least 50% of the crystallized spheroidal graphite particles are less than or equal to 6 microns in size.

2. A nodular graphite cast iron mold for molding plastics comprising:

a composition which consists of 2.5–3.8% by weight of carbon, 2.0–3.0% by weight of silicon, not more than 0.8% by weight of manganese, 2.0–5.0% by weight of nickel, 0.2–1.0% by weight of molybdenum, and the balance being iron, spheroidizing elements and impurities which are necessarily present in the nodular graphite cast iron; and said carbon is crystallized from a melt to result in crystallized spheroidal graphite particles in a peripheral portion of said mold having a particle size distribution wherein at least 90% of the crystallized spheroidal graphite particles are less than or equal to 10 microns in size and at least 50% of the crystallized spheroidal graphite particles are less than or equal to 6 microns in size, said particle size distribution resulting from cooling said melt at a rate of at least 20° C./minute immediately after said melt is poured into a master casting pattern until said melt reaches a temperature of 700° C.

3. The nodular graphite cast iron mold as set forth in claim 2, wherein at least a portion of said master casting pattern which contacts said molten metal to form said molding surface of the cast pattern, comprises a metal material having a high thermal conductivity, said molten metal being brought into close contact with said portion of the master casting pattern by applying a pressure to said molten metal immediately after said molten metal is poured into said master casting pattern.

4. The nodular graphite cast iron mold as set forth in claim 3, where said master casting pattern comprises die steel, and said pressure applied to said molten metal is at least 30 kg/cm$^2$.

* * * * *